US008353350B2

(12) United States Patent
Overfield

(10) Patent No.: US 8,353,350 B2
(45) Date of Patent: Jan. 15, 2013

(54) SUBSEA TEST APPARATUS, ASSEMBLY AND METHOD

(75) Inventor: Timothy Mark Overfield, North Yorkshire (GB)

(73) Assignee: Zetechtics Limited (GB)

( * ) Notice: Subject to any disclaimer, the term of this patent is extended or adjusted under 35 U.S.C. 154(b) by 0 days.

(21) Appl. No.: 12/919,602

(22) PCT Filed: Feb. 25, 2009

(86) PCT No.: PCT/GB2009/000532

§ 371 (c)(1),
(2), (4) Date: Aug. 26, 2010

(87) PCT Pub. No.: WO2009/106826

PCT Pub. Date: Sep. 3, 2009

(65) Prior Publication Data

US 2011/0000677 A1 Jan. 6, 2011

(30) Foreign Application Priority Data

Feb. 26, 2008 (GB) ..... 0803459.7

(51) Int. Cl.
*E21B 47/00* (2012.01)

(52) U.S. Cl. ... 166/336; 166/338; 166/344; 166/250.01; 166/66; 340/853.2

(58) Field of Classification Search ..... 166/336, 166/338, 339, 344, 351, 368, 250.01, 66, 166/360; 340/853.2; 702/6
See application file for complete search history.

(56) References Cited

U.S. PATENT DOCUMENTS

| | | | | |
|---|---|---|---|---|
| 5,883,517 | A * | 3/1999 | Broyde et al. | 324/522 |
| 6,223,675 | B1 * | 5/2001 | Watt et al. | 114/312 |
| 6,513,596 | B2 * | 2/2003 | Wester | 166/336 |
| 6,539,778 | B2 * | 4/2003 | Tucker et al. | 73/49.5 |
| 6,595,487 | B2 * | 7/2003 | Johansen et al. | 251/129.04 |
| 6,644,410 | B1 * | 11/2003 | Lindsey-Curran et al. | 166/360 |
| 6,644,848 | B1 * | 11/2003 | Clayton et al. | 374/7 |
| 6,686,745 | B2 * | 2/2004 | Bass | 324/522 |

(Continued)

FOREIGN PATENT DOCUMENTS

GB 2321139 A 7/1998

(Continued)

OTHER PUBLICATIONS

International Search Report, PCT/GB2009/000532, dated Aug. 28, 2009.

(Continued)

*Primary Examiner* — Matthew Buck
(74) *Attorney, Agent, or Firm* — Lerner, David, Littenberg, Krumholz & Mentlik, LLP

(57) ABSTRACT

Subsea test apparatus comprises: a connector for mating with a corresponding connector of subsea apparatus to provide at least one of electrical, optical, and fluid connection between the test apparatus and the subsea apparatus; measuring means connected to the test apparatus's connector and operable underwater in a measurement mode; a power supply arranged to power the measuring means; and disconnection means for disconnecting the test apparatus's connector from a mated subsea apparatus's connector. The measuring means, in said measurement mode, is arranged to perform at least one measurement, via the mated connectors, on connected subsea apparatus, and the test apparatus further comprises indicating means operable underwater and arranged to provide an indication of a result of the or each measurement.

70 Claims, 6 Drawing Sheets

U.S. PATENT DOCUMENTS

| | | | | |
|---|---|---|---|---|
| 6,817,418 | B2 * | 11/2004 | Gatherar et al. | 166/368 |
| 6,840,088 | B2 * | 1/2005 | Tucker et al. | 73/49.5 |
| 6,937,030 | B2 * | 8/2005 | Liney et al. | 324/642 |
| 7,273,105 | B2 * | 9/2007 | Johansen et al. | 166/336 |
| 7,281,880 | B2 * | 10/2007 | Tucker et al. | 405/154.1 |
| 7,704,016 | B2 * | 4/2010 | Gransaether | 405/188 |
| 8,096,364 | B2 * | 1/2012 | Dursley | 166/338 |
| 2007/0053629 | A1 * | 3/2007 | Meyyappan et al. | 385/15 |
| 2011/0298467 | A1 * | 12/2011 | Douglas | 324/509 |

FOREIGN PATENT DOCUMENTS

| | | | |
|---|---|---|---|
| WO | 91/13233 | A1 | 9/1991 |

OTHER PUBLICATIONS

International Preliminary Report on Patentability and Written Opinion for PCT/GB2009/000532 dated Aug. 10, 2010.

* cited by examiner

SUBSEA TEST APPARATUS, ASSEMBLY AND METHOD

CROSS-REFERENCE TO RELATED APPLICATIONS

This application is a national phase entry under 35 U.S.C. §371 of International Application No. PCT/GB2009/000532 filed Feb. 25, 2009, published in English, which claims the benefit of the filing date of British patent application number 0803459.7, filed on Feb. 26, 2008, the disclosures of which are incorporated herein by reference.

FIELD OF THE INVENTION

The present invention relates to subsea apparatus and the testing of such apparatus, and in particular, although not exclusively, to the testing of subsea interconnecting apparatus' for providing electrical, optical, and/or fluid connection between one piece of subsea apparatus or equipment and another.

BACKGROUND TO THE INVENTION

Subsea is a well-known term used to refer to equipment, methods and technology used at underwater locations, and particularly at locations on or close to the seabed for various applications, and in particular to explore, drill and develop oil and gas fields that exist below the ocean floors. The ocean floor or seabed at which subsea apparatus is used may be at a relatively shallow location (shallow in this context being at depths less than 1,000 feet) or at a deep water location (generally meaning water depths in the range 1,000 to 10,000 feet, or even deeper).

It will be appreciated that a wide variety of types of subsea apparatus (equipment) is used in such applications. This variety includes subsea apparatus providing a control function (for example comprising controllable valves to regulate the flow of fluids to or from a well) and subsea apparatus providing a connection function (such as providing an electrical or optical control or monitoring link between two pieces of apparatus, or providing a fluid conduit from one subsea location to another, for example to convey fluids to a well for injection into that well, or to convey production fluids from a well). A term commonly used to refer to one type of such subsea interconnecting apparatus is "umbilical", and a subsea umbilical will typically comprise a flexible intermediate portion containing at least one electrical cable, optical wave guide, or fluid conduit, with connection means provided generally at each end for connecting the umbilical to other apparatus. For example, umbilicals are known which comprise a plurality of electrical conductors (e.g. wires or cables) with a corresponding plurality of electrical contacts provided in connectors at each end of the umbilical. There are circumstances in which such an umbilical, or indeed another piece of subsea apparatus, is conveyed to a subsea (underwater) location (this operation is also referred to in the art as "deploying" the apparatus) and is required to remain at that location for some time before it is installed (i.e. connected to some other piece of subsea equipment). For example, an umbilical for providing fluid, electrical and perhaps optical connection to a well head may first be laid on the seabed (deployed). Then, an end of the umbilical may be placed into a mechanical receptacle on the well head to provide the fluid connection (and in this condition the umbilical is partially installed). In certain known arrangements the electrical and/or optical connection between the umbilical and well head is provided by connecting another piece of subsea apparatus, known as a "jumper", between a connector on the umbilical and a corresponding connector on the well head. Thus the jumper is another form of subsea interconnect apparatus or device, typical shorter than apparatus referred to as umbilicals, but similarly providing an interconnecting function. When the jumper is connected, the umbilical is then fully installed to the well head. Clearly, although a subsea umbilical or other subsea apparatus can be tested before it is deployed (i.e. before it is conveyed to its subsea location), degradation or damage to it may occur while it is being transported to its deployment location and indeed while it is waiting at that location before installation occurs. For example, if the connectors of subsea apparatus are not protected in some way at the subsea location before installation, then they can in general become contaminated with silt or other material, and any electrical contacts they contain could suffer corrosion. Such degradation is problematic. One attempt to solve these problems has been to fit a so-called "dummy" connector to the connector of subsea apparatus such as an umbilical, the dummy connector mating with the apparatus's connector in the same way as would a corresponding connector of apparatus to which the umbilical is to be connected. Certain known arrangements are such that when the connector and dummy connector are mated at least one seal is made which prevents or at least inhibits the ingress of contaminants into the mated arrangement and prevents seawater from making contact with any electrical contact of the umbilical's connector. Certain dummy connectors are adapted to provide protection to other parts of the connection interface (i.e. not just to electrical contacts). The dummy connector typically remains mated with the connector of the subsea apparatus until shortly before that apparatus is to be installed. The dummy connector is then detached and the subsea apparatus is connected in the required configuration. Although this technique offers some advantages, there is still the possibility that the subsea apparatus could have been damaged or degraded in some way while the dummy connector was in place. For example, although the dummy connector may have protected the connector of an umbilical, the umbilical may have suffered damage elsewhere along its length whilst in situ or waiting for deployment. Only after removal of the dummy connector, and connection of the umbilical to other subsea apparatus may this damage or degradation become apparent, when a problem is detected with the operation of the subsea system as a whole.

It is therefore an object of certain embodiments of the invention to provide subsea assemblies, subsea test apparatus and methods of handling subsea apparatus which overcome, at least partially, one or more of the problems associated with the prior art.

SUMMARY OF THE INVENTION

According to a first aspect of the present invention there is provided an assembly comprising:

- subsea apparatus comprising a connector for mating in a sea-water environment with a corresponding connector of other subsea apparatus to provide at least one of electrical, optical, and fluid connection between the two; and
- subsea test apparatus having a connector mated with the connector of the subsea apparatus so as to provide at least one of electrical, optical, and fluid connection between the subsea apparatus and the subsea test apparatus, the test apparatus further comprising:

measuring means connected to the test apparatus's connector and operable underwater in a measurement mode;

a power supply (e.g. a battery, fuel cell or other supply) arranged to power the measuring means; and disconnection means for disconnecting the test apparatus's connector from the subsea apparatus's connector, wherein the measuring means, in said measurement mode, is arranged to perform at least one measurement, via the mated connectors, on the subsea apparatus, and the test apparatus further comprises indicating means operable underwater and arranged to provide an indication of a result of the or each measurement.

Thus the assembly may be provided at a subsea location, the measuring means may be operated at said location to perform at least one measurement on the connected apparatus, and according to the result of the at least one measurement the test apparatus may then be disconnected (by operation/manipulation of the disconnection means to enable the subsea apparatus to be connected to other subsea apparatus.

In certain embodiments the test apparatus further comprises triggering means for triggering the measuring means to operate in said measurement mode, whereby the assembly may be provided at said subsea location, the measuring means may be triggered at said location to perform at least one measurement on the connected apparatus, and according to the result of the at least one measurement the test apparatus may then be disconnected to enable the subsea apparatus to be connected to other subsea apparatus. Thus, the test apparatus may be in a dormant state until triggered, saving power. Only when triggered may it then switch to operating in the measurement or test mode, and provide the results of those measurements.

In alternative embodiments, however, the test apparatus may be set to monitor the attached apparatus by making measurements continually or at predetermined intervals, without requiring a triggering signal. However, the teat apparatus may be arranged so as to only display or otherwise indicate the results of those measurements (or the most recent one) in response to a triggering signal. Thus, a light source may be used to trigger the test apparatus to show the results of one or more measurements it has made.

In certain embodiments the indicating means is arranged to provide said indication only when the measuring means is in said measurement mode, again conserving power.

In certain embodiments the disconnection means comprises handle means arranged so as to be pullable (or otherwise operable) to exert a force to disconnect said connectors.

In certain embodiments the subsea apparatus's connector is adapted for push-fit mating in a sea-water environment with a corresponding connector of other subsea apparatus. Thus, the connector may be of the type referred to as "wet-mateable".

In certain embodiments the subsea apparatus is interconnecting apparatus comprising:

a further connector for mating in a sea-water environment with a corresponding connector of other subsea apparatus; and interconnecting means arranged to provide at least one of electrical, optical, and fluid connection between the connector and further connector of the subsea apparatus. This interconnecting apparatus may, for example, be of the types referred to commonly as umbilicals and jumpers.

In certain embodiments the interconnecting means comprises at least one of: an electrical conductor; an optical waveguide; and a fluid conduit.

In certain embodiments the subsea apparatus comprises an electrical conductor, and the mated connectors provide an electrical connection between the measuring means and the electrical conductor. The measuring means, in said measurement mode, may then be arranged to measure an electrical impedance (e.g. resistance) between said electrical conductor and seawater. Alternatively, the measuring means, in said measurement mode, is arranged to transmit an electrical impulse (e.g. a voltage pulse) along the electrical conductor and to monitor any reflected or returned signal.

In certain embodiments the subsea apparatus comprises a plurality of electrical conductors, the mated connectors provide a respective electrical connection between the measuring means and each of the plurality of electrical conductors, and the measuring means, in said measurement mode, is arranged to measure an electrical impedance (e.g. resistance) between one of said plurality of electrical conductors and another one of said plurality of electrical conductors. For example, said plurality of electrical conductors may comprise at least three electrical conductors, and the measuring means may be arranged, in said measurement mode, to measure an electrical impedance (e.g. resistance) between at least one selected pair of the at least three conductors. The measuring means may then comprise means for selecting a pair of the at least three conductors, means for applying a test voltage between the selected pair, and means for determining a current flowing between the selected pair. In certain embodiments the means for selecting comprises controllable switch means.

In certain embodiments the measuring means comprises switch means controllable to electrically isolate the test apparatus's connector from its power supply. This can prevent a voltage being applied between contacts which may be exposed to seawater, thereby avoiding the undesirable effects that would otherwise result. In certain embodiments the test apparatus may additionally or alternatively comprise switch means operable to electrically isolate the test apparatus's connector from the measurement means. An advantage of this feature is that it prevents measuring means (e.g. circuitry) from being damaged by any voltage pulses on connected conductors etc. In other words, it can prevent damage to the test apparatus from any applied power on an umbilical to which the test apparatus is connected.

In certain embodiments the subsea apparatus comprises an optical waveguide, and the mated connectors provide an optical connection between the measuring means and the optical waveguide. The measuring means, in said measurement mode, may then be arranged to transmit an optical pulse along said optical waveguide via the mated connectors and to monitor any reflected or returned optical signal.

In certain embodiments the subsea apparatus comprises a fluid conduit, and the mated connectors provide fluid connection between the conduit and the measuring means. Then, the measuring means, in said measurement mode, may be arranged to apply pressure to fluid contained in the conduit, via the mated connectors.

In certain embodiments the mated connectors comprise at least one pair of mated electrical contacts and sealing means arranged to prevent contact between sea water and the mated electrical contacts. For example, one of said mated connectors may comprise a fixed pin having a non-conducting base portion and a conducting tip portion, and the other one of said mated connectors may comprise said sealing means, a movable pin, a spring biasing the movable pin towards a first position, and an electrical contact. The arrangement may be such that, in the mated arrangement, the fixed pin displaces the movable pin from the first position, compressing said spring, such that the conducting tip portion makes electrical connection to the electrical contact and the sealing means forms a seal around the base portion to prevent sea water from making contact with the electrical contact or the tip portion, and such that when the mated connectors are disconnected the spring urges the movable pin into said first position in which the sealing means forms a seal around the movable pin and prevents sea water from making contact with said electrical contact. In certain embodiments it is the test apparatus that comprises said connector comprising a movable pin.

In certain embodiments the triggering means comprises a light detector and is arranged to trigger the measuring means to operate in said measurement mode in response to detection of light by the light detector.

In certain embodiments the indicating means comprises a visual display.

In certain embodiments the disconnection means comprises handle means, the handle means comprising at least one of: a bar; a T-bar; or a loop.

In certain embodiments the test apparatus comprises a rigid housing, the test apparatus connector being rigidly coupled to said housing, and the measuring means being contained within said housing. In alternative embodiments, however, the connector is not rigidly coupled to the housing; it may be connected to the housing and measuring means by a flexible cable, for example.

Another aspect of the invention provides subsea test apparatus comprising:

a connector for mating with a corresponding connector of subsea apparatus to provide at least one of electrical, optical, and fluid connection between the test apparatus and the subsea apparatus;

measuring means connected to the test apparatus's connector and operable underwater in a measurement mode;

a power supply (e.g. at least one battery) arranged to power the measuring means; and disconnection means for disconnecting the test apparatus's connector from a mated subsea apparatus's connector, wherein the measuring means, in said measurement mode, is arranged to perform at least one measurement, via the mated connectors, on connected subsea apparatus, and the test apparatus further comprises indicating means operable underwater and arranged to provide an indication of a result of the or each measurement.

The subsea test apparatus may comprise one or more of the additional features described above in relation to the first aspect of the invention. For example: in certain embodiments the apparatus further comprises triggering means for triggering the measuring means to operate in said measurement mode the indicating means is arranged to provide said indication only when the measuring means is in said measurement mode; the disconnection means may comprises handle means arranged so as to be pullable to exert a force to disconnect the test apparatus's connector from a mated subsea apparatus's connector; and/or the subsea test apparatus's connector may be adapted for push-fit mating in a sea-water environment with a corresponding connector of other subsea apparatus.

In certain embodiments the test apparatus's connector comprises at least one electrical contact for forming an electrical connection to a corresponding electrical contact of a corresponding connector, the electrical contact being connected to the measuring means. Then, the measuring means, in said measurement mode, may be arranged to measure an electrical impedance (e.g. resistance) between said electrical contact and seawater. Alternatively, or additionally, the measuring means, in said measurement mode, may be arranged to apply a voltage pulse to the electrical contact and to monitor a voltage of the electrical contact following the pulse.

In certain embodiments the connector comprises a plurality of electrical contacts, each for forming an electrical connection to a corresponding electrical contact of a corresponding connector, and each being connected to the measuring means. The measuring means, in said measurement mode, may then be arranged to measure an electrical impedance (e.g. resistance) between one of said plurality of electrical contacts and another one of said plurality of electrical contacts. The plurality of electrical contacts may comprise at least three electrical contacts, and the measuring means may be arranged, in said measurement mode, to measure an electrical impedance between at least one selected pair of the at least three contacts. In such examples, the measuring means may comprise means (e.g. switch means) for selecting a pair of the at least three contacts, means for applying a test voltage between the selected pair, and means for determining a current flowing between the selected pair.

Again, the measuring means may comprise switch means controllable to electrically isolate the or each electrical contact from the power supply, and/or the test apparatus may comprises switch means controllable to electrically isolate the or each electrical contact from the measuring means.

In certain embodiments the connector comprises an optical element for forming an optical connection to a corresponding optical element of a corresponding connector, the optical element being connected to the measuring means, and the measuring means, in said measurement mode, is arranged to transmit an optical pulse from said optical element.

In certain embodiments the connector comprises a fluid connector for forming a fluid connection to a corresponding fluid connector of a corresponding connector, the fluid connector being connected to the measuring means, and the measuring means, in said measurement mode, may be arranged to apply pressure to fluid contained in the fluid connector.

In certain embodiments the connector comprises at least one electrical contact, for forming a respective electrical connection to a corresponding electrical contact of a corresponding connector, and sealing means arranged to prevent contact between sea water and the or each electrical contact when the connector is not mated and when the connector is mated with a corresponding connector. Alternative embodiments may additionally or alternatively comprise sealing means arranged to prevent seawater from contacting other elements of the connector, e.g. an optical element or some other component.

In certain embodiments the connector comprises said sealing means, a movable pin, a spring biasing the movable pin towards a first position, and an electrical contact, and the connector is adapted to mate with a corresponding connector comprising a fixed pin having a non-conducting base portion and a conducting tip portion, the arrangement being such that in the mated arrangement, the fixed pin displaces the movable pin from the first position, compressing said spring, such that the conducting tip portion makes electrical connection to the electrical contact and the sealing means forms a seal around the base portion to prevent sea water from making contact with the electrical contact or the tip portion, and such that when the mated connectors are disconnected the spring urges the movable pin into said first position in which the sealing means forms a seal around the movable pin and prevents sea water from making contact with said electrical contact.

In certain embodiments the triggering means comprises a light detector and is arranged to trigger the measuring means to operate in said measurement mode in response to detection of light by the light detector. The indicating means may comprises a visual display, and/or the disconnecting means may comprise handle means, the handle means comprising at least one of: a bar; a T-bar; or a loop.

In certain embodiments the apparatus comprises a rigid housing, the connector being rigidly coupled to said housing, and the measuring means being contained within said housing. In alternatives, the connector may be flexibly connected to the housing.

Another aspect of the invention provides a method of handling subsea apparatus having a connector for mating in a sea-water environment with a corresponding connector of other subsea apparatus to provide at least one of electrical, optical, and fluid connection between the two, the method comprising:

connecting subsea test apparatus to the subsea apparatus by mating a connector of the test apparatus to the connector of the subsea apparatus;

providing the subsea apparatus and connected test apparatus at a subsea location;

operating, at said subsea location, electrically (e.g. battery) powered measuring means of the test apparatus to perform at least one measurement on the connected subsea apparatus via the mated connectors;

providing, with the test apparatus at said subsea location, an indication of a result of the or each measurement;

according to said indication, disconnecting the test apparatus from the subsea apparatus; and mating the connector of the subsea apparatus to the corresponding connector of other subsea apparatus.

In certain embodiments the method further comprises triggering, at said subsea location, the measuring means to perform said at least one measurement.

In certain embodiments said disconnecting comprises pulling handle means of the test apparatus.

In certain embodiments said connecting and said mating each comprise push-fit mating.

In certain embodiments said connecting comprises push-fit mating said connectors in a sea water environment.

In certain embodiments said connecting comprises push-fit mating said connectors in a dry environment.

In certain embodiments said triggering comprises triggering the measuring means using a remotely operated vehicle (ROV) or diver.

In certain embodiments said triggering comprises emitting light from a light source, and detecting the emitted light with a light detector provided on the test apparatus.

In certain embodiments providing said indication comprises providing a visible indication using a visual display. The method may then further comprise viewing said visible indication using a camera of an ROV.

In certain embodiments said disconnecting comprises pulling handle means (e.g. using an ROV).

In certain embodiments said at least one measurement comprises at least one of: an electrical impedance (e.g. resistance) measurement; a time domain reflectometry measurement; a measurement of an attenuation of an electrical or optical signal; and a pressure measurement.

In certain embodiments the method further comprises operating the connected test apparatus in a dormant mode until operating the measuring means to perform said at least one measurement, the dormant mode being a mode in which the measuring means is not performing any measurement on the attached apparatus. Operating in said dormant mode may further comprise isolating electrical contacts of the test apparatus connector from the test apparatus power supply.

In certain embodiments said connecting by mating comprises forming at least one seal between the connector of the test apparatus and the connector of the subsea apparatus, the at least one seal preventing seawater from contacting at least one of an electrical connection, an optical connection, or a fluid connection between the connectors.

BRIEF DESCRIPTION OF THE DRAWINGS

Embodiments of the invention will now be described with reference to the accompanying drawings, of which.

DETAILED DESCRIPTION OF EMBODIMENTS OF THE INVENTION

Figure 1:
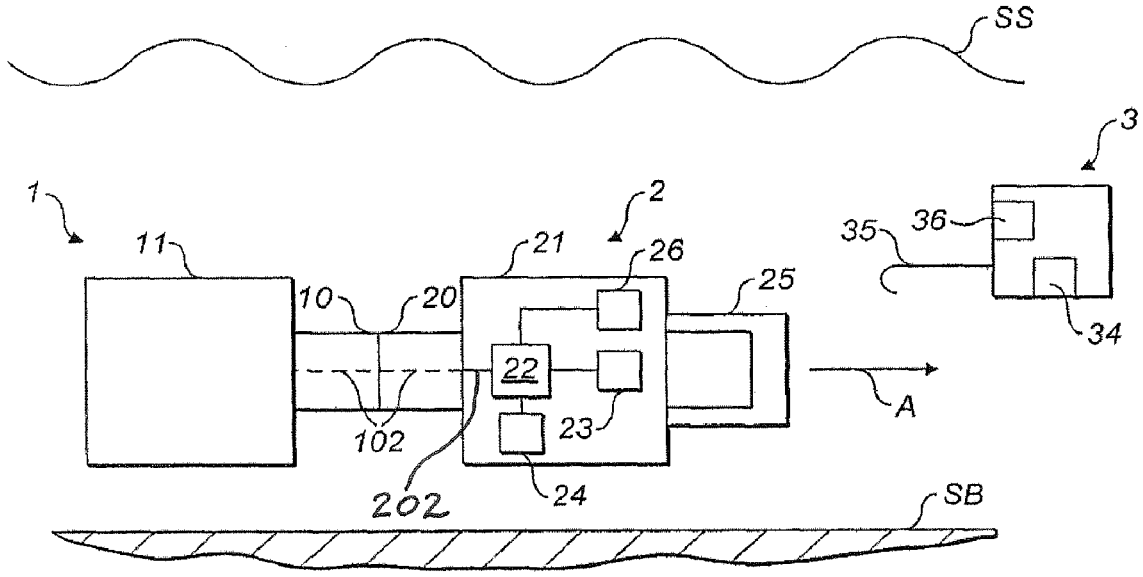
FIG. 1 is a highly schematic representation of an assembly of subsea apparatus and subsea test apparatus embodying the invention.

Referring now to FIG. 1, this shows an assembly of a subsea apparatus 1 and subsea test apparatus 2 at a subsea location, that is immersed in a seawater environment, beneath the sea surface SS and close to the seabed or floor SB. The subsea apparatus 1 comprises a main or body portion 11 and a connector 10. This connector 10 is wet-mateable with the corresponding connector 20 of the subsea test apparatus 2 to form a connection 102 between them, that connection 102 including at least one of an electrical, optical, or fluid connection. The connector 10 is also wet-mateable with a corresponding connector of other subsea apparatus. The connector 10 may be a plug or socket, and the connector 20 may then be a socket or plug respectively. It will be appreciated, however, that in alternative embodiments the connectors may be sexless. The subsea test apparatus 2 comprises a housing 21 to which the connector 20 is rigidly coupled, although in alternative embodiments the housing and connector may be flexibly coupled, for example by a cable. Inside the housing 21 there is provided measuring means 22 connected to the connector 20 by connection 202 and operable underwater in a measurement mode (which may also be described as a test mode or monitoring mode). In this mode, the measuring means performs at least one measurement (which may also be described as at least one test) on the attached apparatus 1. Also inside the housing 21 is provided an electrical power supply 23 in the form of a battery in this example, coupled to the measuring means 22 to power the measuring means. In alternative embodiments, different power supplies may be utilised, e.g. fuel cells. The test apparatus 2 also comprises triggering means 24 operable to trigger the measuring means 22 to operate in the test/measurement mode. The test apparatus 2 also comprises a handle 25 which may be grasped (by person or machine) and pulled in the direction shown by arrow A to disconnect connector 20 from connector 10 (in other words, the test apparatus comprises disconnection means operable (in this example pullable) to decouple the test apparatus from the subsea apparatus 1). Also shown in the figure in highly schematic form is a remotely operable vehicle (ROV) 3 which is controllable to move underwater in a desired manner. The ROV3 comprises activation means 34 for triggering the triggering means 24 of the test apparatus. In certain embodiments this activation means 34 comprises a light, and the triggering means 24 comprises a light detector. The triggering means then causes the measuring means 22 to operate the test mode in response to detecting the light from the ROV3. However, in alternative embodiments the activation means and triggering means may take alternative forms. Thus, an ROV may be used to trigger the measuring means, although alternatively, a diver may trigger the test apparatus at depths up to 300 m. The measuring means 22 when in the test (measurement) mode is arranged to perform at least one measurement, via the mated connectors 10, 20 on the subsea apparatus 1, and the test apparatus further comprises indicating means 26 (also operable underwater, at the illustrated subsea location) and arranged to provide an indication of a result of the measurement or measurements on the attached apparatus 1. In certain embodiments the indicating means 26 comprises a visual display, and this is viewable by a camera 36 on the ROV3. The measurement or measurements performed by the measuring means 22 on the attached apparatus 1 can take various forms, as will be appreciated from the following description. After viewing the results of those measurements using the camera 36 on the ROV3, the operator of the ROV can then decide whether or not the test results are acceptable. If they are, then the ROV3 can be controlled to engage the handle 25 and disconnect the test apparatus 2 from the subsea apparatus 1 by pulling in the direction indicated generally by arrow A using suitable handle engaging means 35. The connector 10 of the subsea apparatus 1 can then be mated with a corresponding connector of other subsea apparatus.

Although in the above example the measuring means had to be triggered before operating in the measurement mode, in alternative embodiments this triggering may not be required; the measuring means may be arranged to monitor the attached apparatus by operating continuously in the measurement mode, making measurements on the attached apparatus at predetermined intervals, for example. The measuring means may be set to operate in this way before the assembly is deployed (to the underwater location). The results of these measurements may be stored in suitable memory means. In certain embodiments, the results of this monitoring are only displayed in response to an external signal (e.g. triggering by a light source). Thus, the test apparatus may be arranged to monitor the attached apparatus, and may then be triggerable to provide the results of those monitoring measurements.

Figure 2:
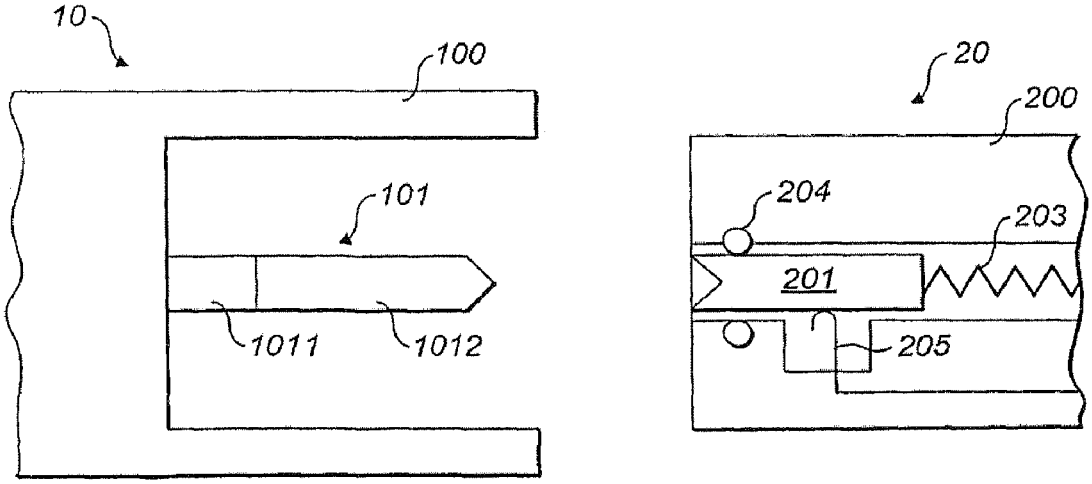
FIG. 2 is a schematic representation of portions of a corresponding pair of wet-mateable connectors for use in embodiments of the invention.

Moving on to FIG. 2, in certain embodiments, the connectors 10 and 20 of the subsea apparatus and subsea test apparatus 2 are wet-mateable, that is they may be mated in a seawater environment, with their design being such that seawater is excluded from contact with the electrical connection they make. In the example of FIG. 2, the connector 10 of the subsea apparatus 1 generally comprises a socket or receptacle 100 for receiving a corresponding plug member 200 of the connector 20. Connector 10 comprises at least one pin 101 having a non-conducting base portion (for example in the form of a hollow collar) 1011 and an electrically conducting tip portion 1012. Although not shown in the figure, the connector 10 also comprises an electrical connection from the tip of portion 1012, through the insulating base portion 1011 to enable the conductive tip 1012 to be connected to electrical elements within the apparatus 1. The connector 20 comprises a moveable pin 201 biased towards a first position (as shown in the figure) by a spring 203. The connector 20 also comprises sealing means 204, which in this example is in the form of an O ring, which, when the moveable pin 201 is in the first position forms a seal around that moveable pin, preventing the ingress of water into the connector 20 and so preventing that seawater from coming into contact with an electrical contact 205 housed within the connector 20. When the connectors 10 and 20 are mated, the plug portion 200 is inserted into the corresponding socket defined by connector 10, and the end of tip portion 1012 engages the end of moveable pin 201. As the connectors are pushed into yet closer engagement, the tip portion 1012 pushes the moveable pin 201 further into the connector body 200, compressing spring 203. The sealing means 204, when the moveable pin 201 has been pushed out of engagement, seals against the contact pin 101, and when the connectors are fully mated, the sealing means 204 forms a seal against the non-conductive base 1011 of the connector pin 101. In this position the conductive tip portion 1012 makes electrical connection with the contact 205 of the connector 20. Thus, in the fully mated position, the sealing means 204 prevents seawater from making contact with any part of the conducting tip portion 1012 and indeed for making any contact with the electrical connection between the tip portion 1012 and the contact 205. It will be appreciated that when the connectors 10 and 20 shown in FIG. 2 are used in the assembly of FIG. 1, this provides the advantage that in the assembled configuration the sealing means 204 of the connector 20 of the test apparatus 2 prevents connection between seawater and the conductive tip or tips of the connector 10, so preventing corrosion. The fit of the plug portion 200 into the socket 100 can also be arranged to completely or substantially eliminate ingress of silt or other contaminants into connector 10, thus preserving its integrity for connection to other apparatus after measurements have been made using the mated test apparatus 2.

This provides the advantage that the subsea test apparatus can be fitted to the subsea apparatus and provide the same protection as the previously used dummy connectors, whilst offering the further advantage that the test apparatus can perform a measurement (which may also be described as a test or check) on the connected subsea apparatus at the subsea location before it is installed. The test apparatus can remain coupled to the test apparatus for even prolonged periods of time, and simply has to be triggered to perform its measurements at a suitable time shortly before the apparatus under test (i.e. the apparatus being measured or monitored) is to be installed. Then, after performing the measurement or measurements, the test apparatus can simply be detached in the same way that a conventional dummy connector would be removed, for example by pulling its handle 25. Thus, the test apparatus offers the protection and measurement functions, without requiring any additional manipulation step to be performed by an ROV or diver.

Figure 3:
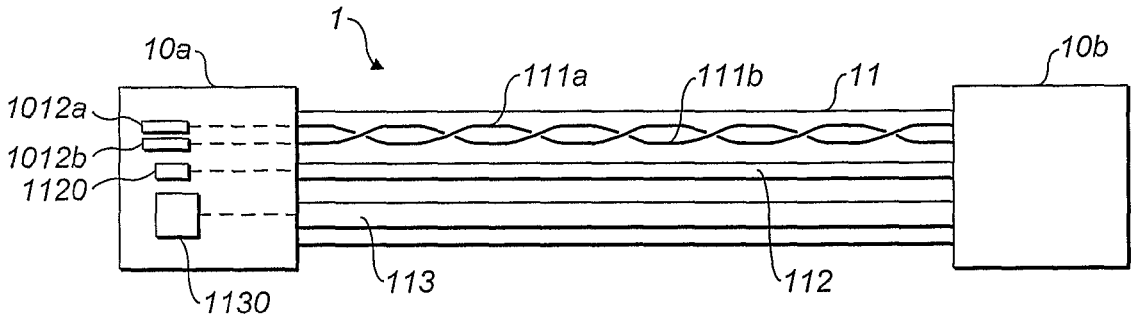
FIG. 3 is a schematic representation of interconnected apparatus (which may be referred to as an umbilical) for use in assemblies and methods embodying the invention.

Referring now to FIG. 3, this shows subsea interconnecting apparatus 1 (e.g. an umbilical or jumper) which may be used in assemblies and methods embodying the invention. This interconnecting apparatus 1 comprises a central portion or body portion 11 which includes interconnecting means comprising a twisted pair of electrical conductors 111*a*, 111*b*, an optical wave guide 112, and a fluid conduit 113. The interconnecting apparatus 1 is terminated at each end by a respective connector 10*a*, 10*b* for mating with corresponding connectors of other subsea apparatus and test apparatus embodying the invention. Connector 10*a* comprises a pair of electrical contacts 1012*a*, 1012*b* respectively connected to the two wires or cables 111*a*, 111*b* of the twisted pair. The connector 10*a* also comprises an optical element 1120 optically coupled to the wave guide 112. Also, the connector 10*a* comprises a fluid connector 1130 coupled to the conduit 113 and by means of which other apparatus can be coupled to that conduit. Although not shown in the figure, connector 10*b* comprises a corresponding array of electrical contacts, optical element and fluid connector such that the interconnecting apparatus 1 can be connected between two pieces of subsea apparatus to provide electrical, optical and fluid communication between the two.

Figure 4:
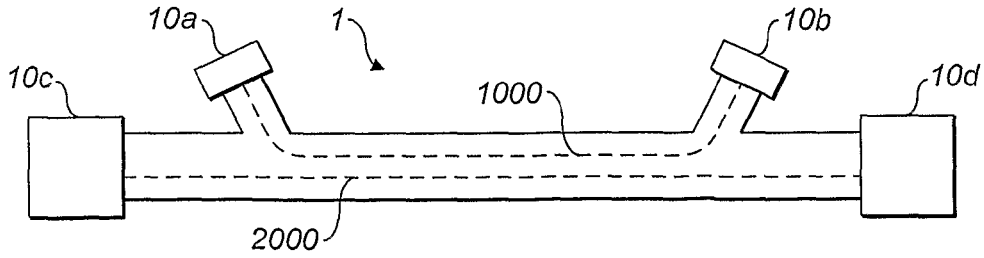
FIG. 4 is a schematic representation of another umbilical for use in assemblies and methods embodying the invention.

FIG. 4 illustrates an alternative form of interconnecting apparatus which may be used in assemblies and methods embodying the invention. In this example, connectors 10*a* and 10*b* terminate electrical and/or optical interconnecting means 1000, and separate connectors 10*c* and 10*d* terminate fluid interconnection means 2000 which may comprise one or more conduits.

Figure 5:
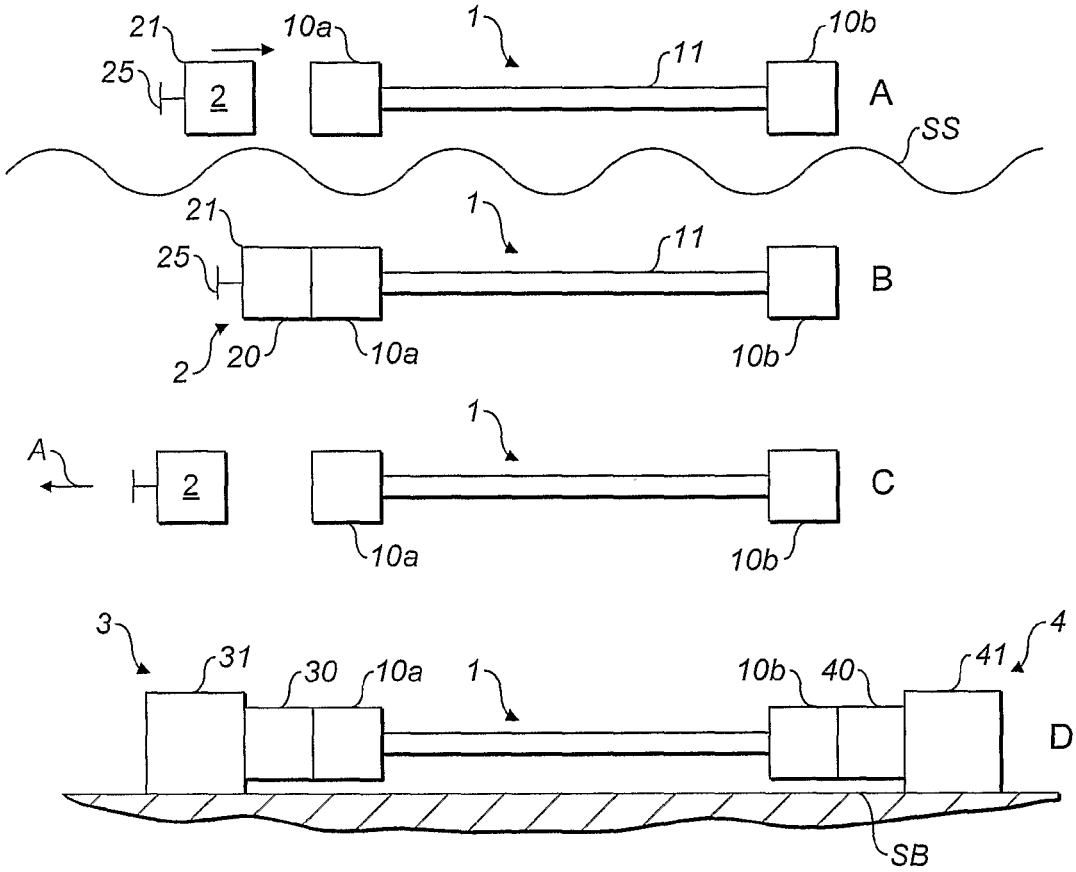
FIG. 5 is a schematic representation illustrating a method of handling and testing subsea apparatus in accordance with an embodiment of the invention.

Moving on to FIG. 5, this illustrates some of the steps in a method of handling subsea apparatus embodying the invention. In this embodiment, the subsea apparatus is again an interconnecting umbilical 1 having a flexible central portion 11 terminated at each end by respective connectors 10*a* and 10*b*. In a first step A, the apparatus 1 is arranged in a dry environment (not beneath the sea surface SS) and test apparatus 2 is mated with the connector 10*a* to make a connection between the measuring means contained within the apparatus 2, that connection including at least one of an electrical, optical, or fluid connection. Having formed this assembly in step A, step B is performed in which the assembly is conveyed to a subsea location. After a period of time at that location, the test apparatus 2 (which has in the meantime been protecting connector 10*a*) then performs at least one measurement on the attached apparatus 1. For example, where the interconnecting apparatus 1 comprises one or more electrical conductors, this measurement may comprise the measurement of an electrical resistance between one of those conductors and another one of those conductors, or between one of those conductors and seawater. Such a measurement can determine the integrity of any electrical insulation in the structure. Alternatively, measuring means may use time domain reflectometry techniques to test the attached apparatus 1, by sending a voltage pulse along one or more of the apparatus's electrical conductors and monitoring any reflected signals. This can give information on any breaks or other damage to electrical conductors in the structure 11 and their position or positions. Alternatively, if the interconnect 1 comprises one or more optical wave guides, the measuring means may be adapted to perform a measurement which comprises the sending of a light signal along one or more of those wave guides. For example, the measuring means may use optical time domain reflectometry techniques, that is it may send a light pulse along one or more of the wave guides, and monitor any reflections. Again, this can provide information on the integrity of an optical wave guide in the apparatus 1 and provide information on the location of any break or other damage. Also, if the interconnecting apparatus 1 comprises a fluid conduit, then the measuring means may be arranged to test the integrity of that conduit by applying pressure to fluid contained within it.

Although not shown in FIG. 5, while the test apparatus is connected and performing its measurement(s) the other end of the interconnecting apparatus 1 may have a dummy plug connected to its connector 10*b*. That dummy plug may, for example, be arranged to provide a short or connection with predetermined resistance between certain electrical conductors in the umbilical. The dummy plug may be arranged to provide other termination conditions, which the test apparatus may utilise to make its measurement(s) on the apparatus 1. For example, the dummy plug may connect together two optical waveguides in the umbilical, such that the test apparatus may send an optical signal down one and look for a signal returned along the other. In other embodiments, an active device may be connected to connector 10*b*, to interact with the test apparatus connected to the other end and perform one or more measurements.

Although not shown in the figure, after making one or more of these measurements, the test apparatus 2 then provides an indication of the results so that an operator can make a decision as to the suitability of the apparatus 1 for deployment. If that determination is positive, then in step C the test apparatus 2 is removed by separating it from the connector 10*a* (for example by pulling a handle to displace the test apparatus in the direction generally indicated by arrow A). Then, in a final step D the interconnecting apparatus 1 is installed to connect one piece of subsea apparatus 3 to another piece of subsea apparatus 4, in this example both of those pieces of equipment being provided at or close to the seabed SB. This installation comprises the mating of connector 10*a* with a connector 30 attached to the housing 31 of apparatus 3, and the connection of connector 10*b* to a corresponding connector 40 attached to the housing 41 of the other apparatus 4.

Figure 6:
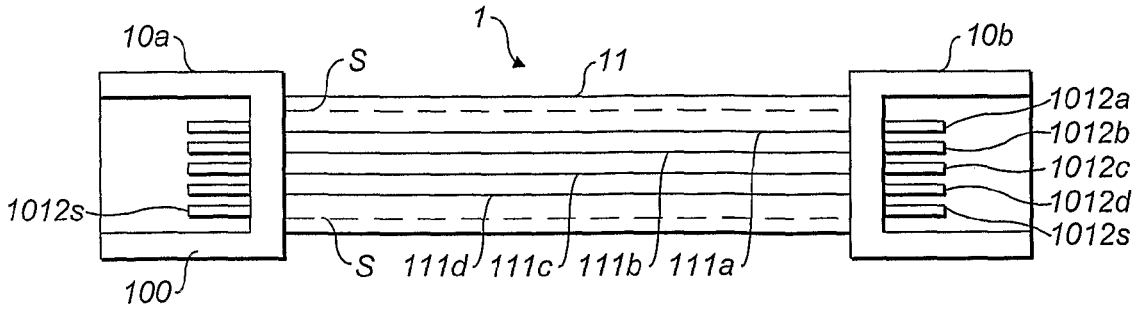
FIG. 6 is a schematic representation of an electrical interconnector (or umbilical) for use in assemblies and methods embodying the invention.

Referring now to FIG. 6, this shows another example of interconnecting apparatus 1 which may be used in assemblies and methods embodying the invention. This interconnecting apparatus 1 is an electrical umbilical comprising a flexible, elongate central portion 11 comprising four electrical conductors (wires, cables) 111*a-d*. The umbilical also comprises a screen or shield S providing electromagnetic and/or mechanical shielding of the conductors 111*a-d*. Again, each end of the umbilical 1 is terminated by a respective connector 10*a*, 10*b*, each of these connectors comprising a plurality of electrical contacts 1012*a-d* providing electrical connection to the conductors 111*a-d* respectively. Each connector also comprises a further electrical contact 1012*s* providing electrical connection to the shield or screen S. In certain embodiments of the invention, the test apparatus is arranged to measure electrical resistance between a selected pair of the contacts 1012*a-d* and S in order to determine the integrity of electrical insulation between pairs of the electrical conductors and between the electrical conductors and the screen or shield S. The test apparatus may be further arranged to make electrical resistance measurements between a selected one of the electrical conductors or the screen and seawater.

Figure 7:
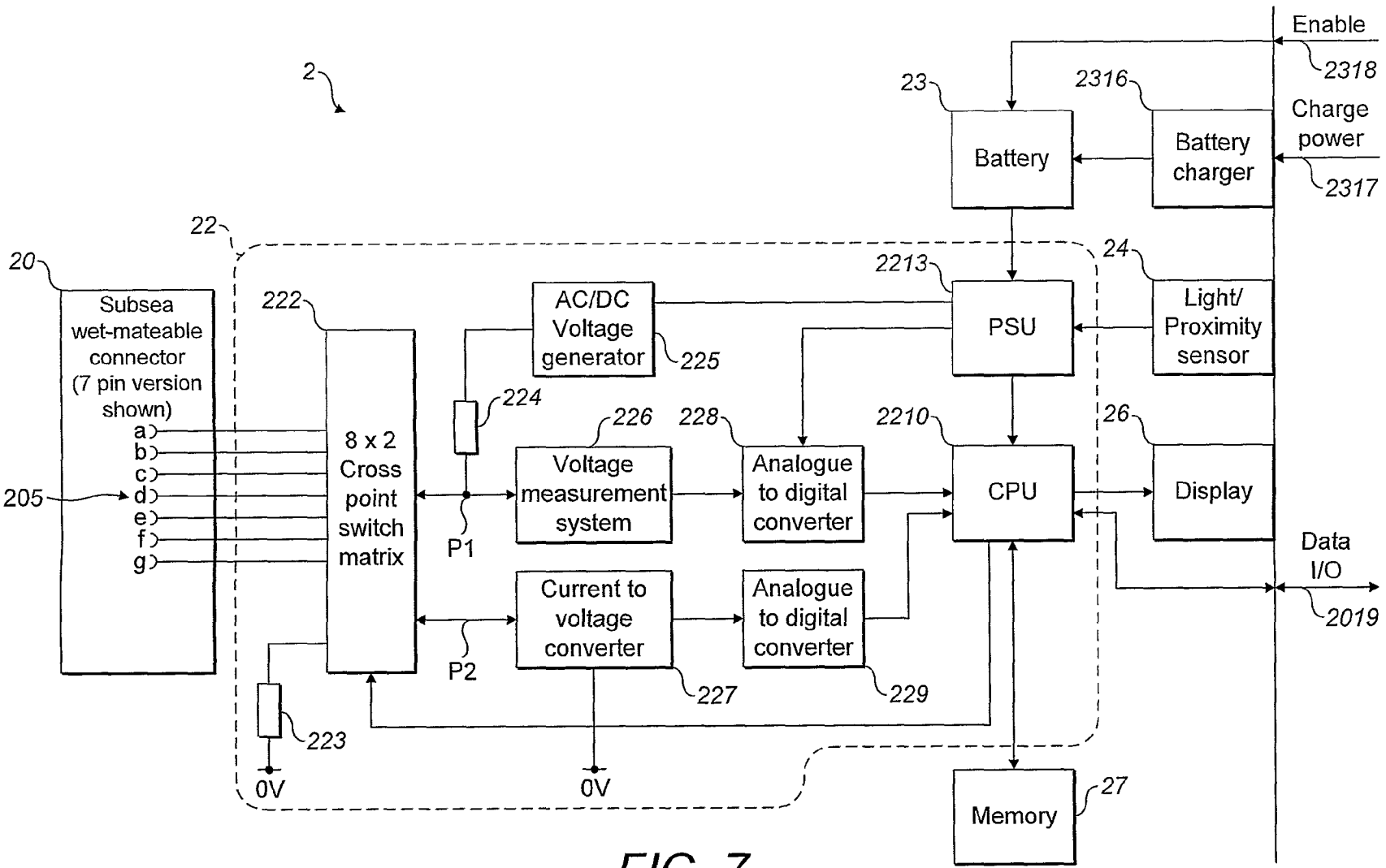
FIG. 7 is a schematic representation of components of subsea test apparatus embodying the invention.
Figure 8:
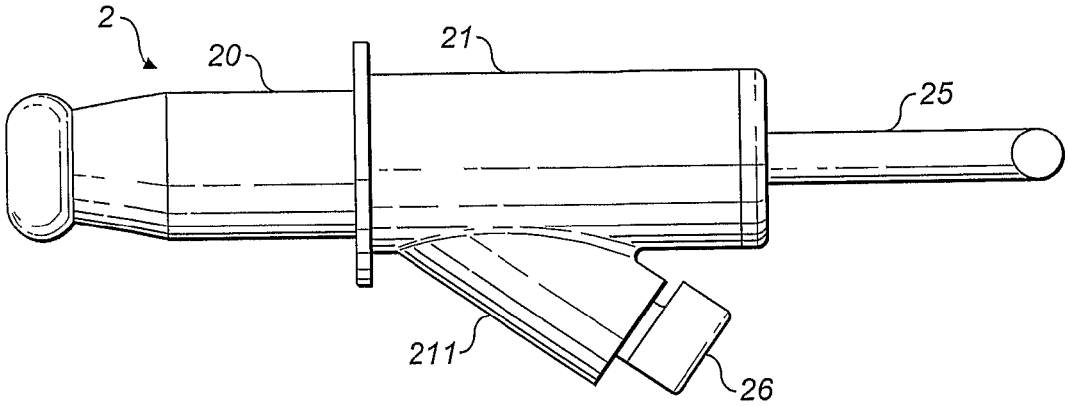
FIGS. 8-11 are external side, plan, rear and perspective views respectively of the test apparatus of FIG. 7.
Figure 9:
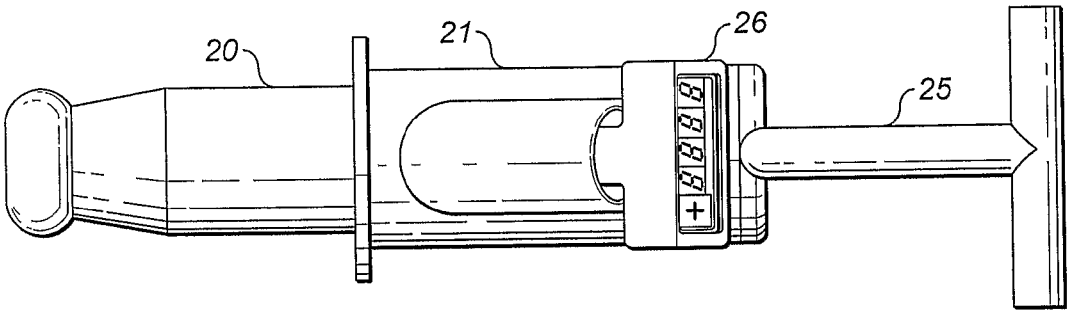
Figure 10:
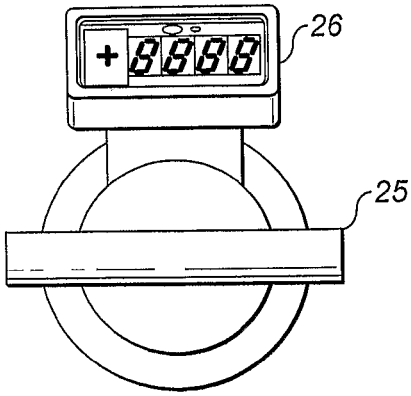
Figure 11:
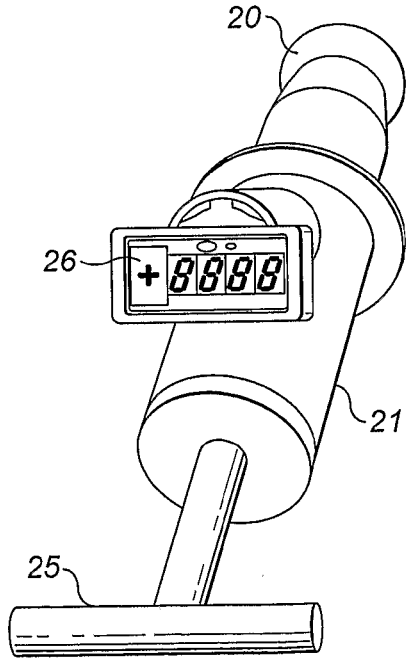

Referring now to FIG. 7, this illustrates details of subsea test apparatus embodying the invention and which may be used to protect and then test interconnect apparatus of the general type illustrated by FIG. 6. FIGS. 8-11 show the external appearance of the test apparatus. The test apparatus of FIGS. 7-11 may also be referred to as a Monitoring Plug (MP), and comprises the following parts: Subsea Wet Mateable Connector 20; Crosspoint Switch Matrix (controllable switching means) 222; Internal Test Resistor 223; Ballast Resistor 224; AC/DC Voltage Generator 225; Voltage Measurement System 226; Current to Voltage Converter 227; Analogue to Digital Converter 228; Analogue to Digital Converter 229; Central Processing Unit (CPU) 2210; Memory 27; Battery 23; Power Supply Unit (PSU) 13; Light/Proximity Sensor 24; Display 26; Battery Charger 2316; Charge Power Input Connector 2317; System Enable Connector 2318; and Data I/O Connector 2019.

The MP 2 is designed to operate on a ships deck or under water from the Splash or Interface Zone (i.e. the Surface) continuously to depths in excess of 3000 msw. It would normally be attached to a piece of underwater equipment (the Device Under Test or DUT) that requires monitoring of some physical property from the point at which it is moved from its storage position on the vessel to its deployment position on the seabed. The user of the MP can view the results of the monitoring process before moving the DUT from its deployed location to its final position in the overall subsea assembly and possibly connecting it to other components. By this means the condition of the DUT can be monitored and further operations on it can be aborted if the monitoring device shows that the monitored property is no longer within acceptable limits.

The description following relates to monitoring of Electrical Insulation Resistance. However, in alternative embodiments the measuring means 22 may be adapted to monitor other physical properties of the Device Under Test.

In use, the MP 2 is connected to the DUT via the Subsea Wet Mateable Plug (20). The DUT could be a subsea umbilical, jumper, flying lead, manifold or other subsea item. Plug (i.e. connector) 20 is such that it provides a mating half to that installed on the DUT. Seven connection points (electrical contacts 205*a-g*) are shown but the MP in alternative embodiments may have more or fewer, depending on the application. In certain embodiments, one connection point 205 is arranged so as to be connected to seawater via the shell or housing of connector 20 when the apparatus is submerged.

In certain embodiments the MP components 22, 23, and 27 are installed within the body of connector 20, but in alternative embodiments this is not necessarily the case.

Each of the connection points (contacts 205) (male and/or female) of connector 20 are connected to a crosspoint switch 222 which may be electro-mechanical or semiconductor. The crosspoint switch allows any of the connection points to be switched to any of the measurement points P1, P2. The operation of the crosspoint switch arrangement is under the control of the Central Processing Unit 2210 which selects the switches to be operated in order to achieve the required interconnection:

An additional connection point is provided to allow for the connection of a Test Resistor 223 which simulates a connection to the DUT and allows the system to execute an internal self test function for confidence checking.

The AC/DC voltage generator 225 generates a test potential which (depending on the application) could be DC, AC or alternating DC. The frequency of any test potential is again, application dependent.

The Ballast Resistor 224 represents the current limiting function of 225 so that gross failures do not cause damage to internal or external components.

The voltage applied to Measurement Point P1 is measured by 226 which conditions the signal suitable for the Analogue to Digital Converter 228.

The resultant current into the DUT via 20 and 222 is measured by the Current to Voltage Converter 227 which conditions the signal for the Analogue to Digital Converter 229. As the monitoring current forms a loop it returns to the battery 23 via 227.

The two ADCs 228 and 229 are controlled via the CPU (12210 and the resulting measurements are processed to calculate the Insulation Resistance via Ohms Law.

The results can be stored in the memory 27 for later use.

The Display 26 shows the worst case measurement between any of the connection points which is calculated by comparing all the results held in the memory 27. This may be the worst case at this instant in time or since the MP was deployed or for some other period. The display may show other information from time to time to pass across other information to the user. This information may be in alphanumeric or coded form.

The results may also be downloaded via the Data I/O connector 2019 when the MP is retrieved. In certain embodiments 2019 is a subsea mateable connector, and this information can then be recovered whilst the MP is deployed. 2019 may form part of 20 and be internally disconnected when measurements of the connecting points 205 in 20 are under way.

The Light/Proximity sensor 24 detects the presence of equipment that can read the display 26. It may detect the presence of light from the camera systems on the ROV or Diver, or may detect their presence by other means such as (but not limited to) magnetic or electric fields, etc. The sensor (or triggering means) 24 when enabled (actuated/activated), powers up the electronic systems such that measurement, display and storage of data can occur. When disabled (not activated) it is arranged to cause at least some of the internal electronic systems to power down, thus saving battery life. Thus the system will only show data when there is equipment around to view the display or recover data from the Data I/O socket 2019.

The entire electronic systems can be switched off via the Enable function 2318 so that no current is consumed and all the electronics are disabled and un-powered. The Enable function may take the form of a removable plug that physically disconnects the battery terminals or it may be a switch or internal relay contact. 2318 may form part of 20 and be internally disconnected when measurements of the connecting points in 20 are under way.

The battery 23 powers the entire system when it is active and may be a primary or secondary cell. If the latter then this can be recharged from an external power source 2317 via a connector. The charging power is controlled via the Battery Charger circuitry 2316 which is shown as an internal function, but could equally be fitted externally. The MP electronics may or may not be powered and/or operating whilst the battery is being recharged. 2317 may form part of 20 and be internally disconnected when measurements of the connecting points 205 in 20 are under way.

Referring now to the external views of FIGS. 8-11, this test apparatus 2 embodying the invention is in the form of a plug for insertion in the corresponding receptacle of apparatus for subsea application, and is adapted for disconnection from such apparatus at a subsea location by manipulation by an ROV or diver. The test apparatus 2 comprises a rigid housing 21 having a side arm 211 from which the visual display 26 extends. Connected to the housing 21 and projecting from that housing 21 in a forwards direction is a connector or plug portion 20 for insertion inside a suitably adapted receptacle of other subsea apparatus. In this example, although not shown in the figures, the connector 20 comprises the plurality of electrical contacts 205 for making respective individual contacts with pins provided in the receptacle. The housing 21 contains the measuring means 22 adapted to perform one or more electrical measurements on connected subsea apparatus by means of the electrical contacts in the connector 20. The results of these measurements are then displayed on the visual display 26. The test apparatus comprises handle means in the form of a T-bar 25 to facilitate pulling of the test apparatus to disconnect it from other apparatus.

Figure 12:
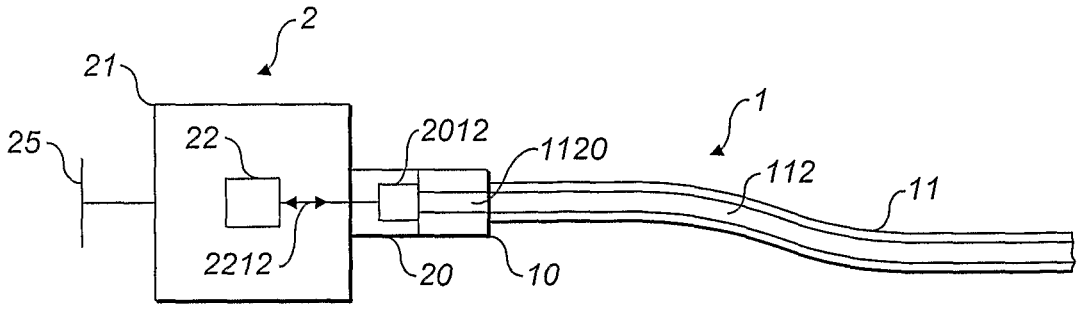
FIG. 12 is a schematic representation of test apparatus embodying the invention being used to perform an optical measurement on a connected piece of subsea apparatus.

Referring now to FIG. 12, this shows test apparatus in accordance with another embodiment of the invention connected to subsea apparatus 1. The subsea apparatus comprises an optical wave guide 112 having an end portion 1120 contained in its connector 10. The test apparatus 2 comprises an optical element 2012 in its connector 20 which, when the connectors 10 and 20 are mated together as shown in the figure provide an optical connection to the wave guide 112. The optical element 2012 is connected by connection means 2212 to the measuring means 22. In the test mode, the measuring means 22 is arranged to emit a pulse of light into the wave guide 112 via the optical element 2012, and then monitors for any reflected light signal. In this way, that is by using optical time domain reflectometry techniques, the test apparatus 2 can determine if there are any breaks or other regions of damage in the optical wave guide 112, and furthermore can determine their position. This determination can be made before the test apparatus is disconnected from the apparatus 1. While the connectors 10 and 20 are in the mated condition, this can provide physical protection to the connector 10, and specifically its optical connection means 1120, while the apparatus 1 is awaiting deployment.

Although an optical TDR technique is described above, in alternative embodiments the measuring means may be arranged to perform measurements on attached apparatus using electrical TDR techniques. In one such technique, a fast rise time pulse is transmitted along the conductor (being tested/monitored/measured). If the conductor is of uniform impedance and properly terminated (for example by means of a dummy plug at its other end) the entire transmitted pulse will be absorbed in the far-end termination and no signal will be reflected back to the measuring means (which may incorporate a time domain reflectometer). However, where impedance discontinuities exist along the conductor, each discontinuity will create reflected signal (in effect an echo) that is reflected back to the measuring means. Increases in impedance create a reflected signal that reinforces the original pulse, while decreases in impedance create a reflected signal that opposes the original pulse. The resulting reflected pulse that is measured at the measuring means may be stored or displayed as a function of time and, because the speed of signal propagation is relatively constant for a given transmission medium, can be read as a function of cable length. As a result of this sensitivity to impedance variations, TDR techniques may therefore be used to verify cable impedance characteristics, splice and connector locations and associated losses, and estimate cable lengths, because every in-homogeneity in the impedance of the cable produces a corresponding reflected signal.

Although TDR techniques are described above, in alternative embodiments measurements of signal attenuations may be made in order to monitor/test the subsea apparatus prior to its installation.

Figure 13:
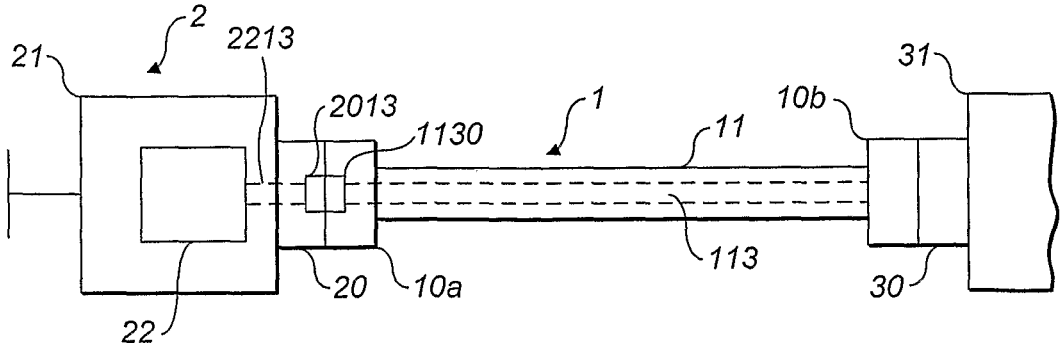
FIG. 13 is a schematic representation of another test apparatus embodying the invention being used to perform a test on a fluid conduit of a piece of connected subsea apparatus.

Referring now to FIG. 13, this shows test apparatus in accordance with another embodiment of the invention, connected via connector 10*a*, to interconnecting apparatus having a flexible central portion 11 including a fluid conduit 113, and which has at its other end a connector 10*b* mated with a connector 30 of further subsea apparatus 31. The connector 20 of the test apparatus includes a fluid connector 2013 which forms a fluid connection to a corresponding fluid connector 1130 of connector 10*a*. Fluid connector 2013 is in fluid connection with measuring means 22. Thus, the arrangement is such that the measuring means 22 is in fluid communication with the conduit 113 in the interconnect apparatus 1. In the test mode, the measuring means 22 is arranged to apply a pressure to fluid contained within the conduit 113 (via the mated connectors 2013, 1130). By applying a pressure and then seeing how this pressure is maintained, or decays, the measuring means can therefore determine the integrity of the conduit 113.

From the above, it will be appreciated that certain embodiments of the invention provide test apparatus in the form of a Jumper Monitoring Plug (JMP). The device 2 may be in the form of a 'Dummy Plug' with a Tronic™ Connector (or similar) at one end of the body and an ROV 'T Bar' or other handle at the other. Within the body of the 'Dummy Plug' (or Jumper Monitoring Plug, JMP) may be the monitoring electronics and a battery supply. A digital display may be fitted in the area that a cable would exit in a normal jumper plug. The JMP may be installed at one end of a deployed Umbilical/Jumper in place of a conventional Dummy Plug. The JMP may be installed and removed in the same manner as that used for a conventional Dummy Plug. The JMP may be arranged to activate upon being illuminated (for example via ROV lighting, or some other controlled lighting, such as a diver-operated light source). At this point the JMP may undertake a sequence of insulation resistance tests (this may take several seconds). The JMP display may be arranged show the worst insulation resistance measurement found (core to core, core to seawater, etc.) to give a go/no go indication. If the electrical conductors in the connected apparatus are screened then the JMP may be arranged to connect to the screen and to measuring the insulation resistance between the screen and seawater. The JMP display may be arranged to communicate to equipment and/or an operator at a surface (not subsea) location via a video link on the ROV. Such surface equipment may be arranged to extract the results of all the resistance tests and automatically generate a report on the jumper (attached interconnect device/umbilical). The JMP may be programmed with its serial number, its location (Jumper Identity, etc) and the cores (e.g. conductors, electrical waveguides, conduits) being monitored. In this way this information may be included in the generated report. This identity may be updateable, so that the JMP can be reused on future installations. When de-activated (i.e. not illuminated by an ROV) the electronics within the Jumper Monitoring Plug may disconnect from the Jumper/Umbilical cores so that the JMP electronics are not damaged or incorrect insulation readings generated when conventional insulation measurement equipment is used or if the jumper is inadvertently connected to a powered umbilical whilst the JMP is still attached. The battery life depends on the available space for the battery but in certain embodiments may be between 3-6 months. In certain embodiments the JMP is 3000 m rated. Shock, vibration and temperature specification requirements may be similar to ISO 13628 Part 6 2004.

It will also be appreciated that certain embodiments provide a Subsea Monitoring System. However, although certain embodiments are specifically for the subsea oil industry, embodiments may have applications in other hostile/specialist environments. Certain embodiments provide units for test and/or monitoring that are temporarily or permanently attached to a Device Under Test (DUT) to monitor one or more electrical/hydraulic/pneumatic/optical/or other physical properties of that device (or further devices attached to the first device). The units may be self contained and are generally deployed with the DUT into the hostile environment, but may be installed at another time. Certain embodiments provide an 'active' Dummy Connector which is fitted in place of the conventional Dummy Connector that would normally be fitted to protect the permanently installed connector half during transit & installation. This Dummy (active or otherwise) is generally removed at the point at which the DUT is installed into the system and permanent interconnection systems such as cables/hoses/jumpers/umbilicals are connected to form the installed whole. The unit embodying the invention may also take the form of a measurement system connected to a normal rather than 'dummy' connector. In certain embodiments the measured/monitored measurand(s) are to be displayed on an optical readout and/or communicated via optical/electrical/magnetic/electromagnetic or other physical signals to other equipment. The measured value is instantly available and whilst it maybe permanently (or temporarily) stored or data-logged the information is easily available for use without removing the unit. A specific example of use of test apparatus embodying the invention is to monitor the electrical insulation resistance of a subsea umbilical or other structure during and after its deployment to the seabed. The unit may resemble a conventional Dummy Connector but contains a power source, measuring electronics and an optical display. The measured electrical resistance is available on the optical display that can be viewed by a diver, underwater vehicle or other monitoring device. The measured value can be used to give information for an aspect of the state of the umbilical from which operational decisions can be taken. Units embodying the invention are easily removed or interchanged before the next (or some subsequent) phase or operation. The units may be reused or may be regarded as disposable. In a specific example, the monitoring unit is installed within (or connected to) a subsea mateable connector that allows electrical connection to the device under test or device being monitored. When required the monitoring unit can be removed by a diver, underwater vehicle or other underwater mechanism. The subsea mateable connectors used in embodiments of the invention may be commercially available items, but alternatively could be connectors designed specifically for test/monitoring purposes. A test or monitoring unit embodying the invention may feature a mechanism that allows it to enter a 'dormant state' to reduce power consumption after a period of inactivity or for a predetermined (or otherwise) period. The unit may be arranged to be 'awoken' by an external impulse or signal or by some other trigger.

The invention claimed is:

1. An assembly comprising:

subsea apparatus comprising a connector for mating in a sea-water environment with a corresponding connector of other subsea apparatus to provide at least one of electrical, optical, and fluid connection between the two; and subsea test apparatus having a connector mated with the connector of the subsea apparatus so as to provide at least one of electrical, optical, and fluid connection between the subsea apparatus and the subsea test apparatus, the test apparatus further comprising:

measuring means connected to the test apparatus's connector and operable underwater in a measurement mode;

a power supply arranged to power the measuring means; and disconnection means for disconnecting the test apparatus's connector from the subsea apparatus's connector, wherein the measuring means, in said measurement mode, is arranged to perform at least one measurement, via the mated connectors, on the subsea apparatus, and the test apparatus further comprises indicating means operable underwater and arranged to provide an indication of a result of the or each measurement, whereby the assembly may be provided at a subsea location, the measuring means may be operated at said location to perform at least one measurement on the connected apparatus, and according to the result of the at least one measurement the test apparatus may then be disconnected to enable the subsea apparatus to be connected to other subsea apparatus.

2. An assembly in accordance with claim 1, wherein the test apparatus further comprises triggering means for triggering the measuring means to operate in said measurement mode, whereby the assembly may be provided at said subsea location, the measuring means may be triggered at said location to perform at least one measurement on the connected apparatus, and according to the result of the at least one measurement the test apparatus may then be disconnected to enable the subsea apparatus to be connected to other subsea apparatus.

3. An assembly in accordance with claim 1, wherein the indicating means is arranged to provide said indication only when the measuring means is in said measurement mode.

4. An assembly in accordance with claim 1, wherein the disconnection means comprises handle means arranged so as to be pullable to exert a force to disconnect said connectors.

5. An assembly in accordance with claim 1, wherein the subsea apparatus's connector is adapted for push-fit mating in a sea-water environment with a corresponding connector of other subsea apparatus.

6. An assembly in accordance with claim 1, wherein the subsea apparatus is interconnecting apparatus comprising:

a further connector for mating in a sea-water environment with a corresponding connector of other subsea apparatus; and interconnecting means arranged to provide at least one of electrical, optical, and fluid connection between the connector and further connector of the subsea apparatus.

7. An assembly in accordance with claim 6, wherein the interconnecting means comprises at least one of: an electrical conductor; an optical waveguide; and a fluid conduit.

8. An assembly in accordance with claim 1, wherein the subsea apparatus comprises an electrical conductor, and the mated connectors provide an electrical connection between the measuring means and the electrical conductor.

9. An assembly in accordance with claim 8, wherein the measuring means, in said measurement mode, is arranged to measure an electrical impedance between said electrical conductor and seawater.

10. An assembly in accordance with claim 8, wherein the measuring means, in said measurement mode, is arranged to transmit an electrical impulse along the electrical conductor and to monitor any reflected or returned signal.

11. An assembly in accordance with claim 1, wherein the subsea apparatus comprises a plurality of electrical conductors, the mated connectors provide a respective electrical connection between the measuring means and each of the plurality of electrical conductors, and the measuring means, in said measurement mode, is arranged to measure an electrical impedance between one of said plurality of electrical conductors and another one of said plurality of electrical conductors.

12. An assembly in accordance with claim 11, wherein said plurality of electrical conductors comprises at least three electrical conductors, and the measuring means is arranged, in said measurement mode, to measure an electrical impedance between at least one selected pair of the at least three conductors.

13. An assembly in accordance with claim 12, wherein the measuring means comprises means for selecting a pair of the at least three conductors, means for applying a test voltage between the selected pair, and means for determining a current flowing between the selected pair.

14. An assembly in accordance with claim 13, wherein the means for selecting comprises controllable switch means.

15. An assembly in accordance with claim 8, wherein the measuring means comprises switch means controllable to electrically isolate the test apparatus's connector from the power supply.

16. An assembly in accordance with claim 1, wherein the subsea apparatus comprises an optical waveguide, and the mated connectors provide an optical connection between the measuring means and the optical waveguide.

17. An assembly in accordance with claim 16, wherein the measuring means, in said measurement mode, is arranged to transmit an optical pulse along said optical waveguide via the mated connectors and to monitor any reflected or returned optical signal.

18. An assembly in accordance with claim 1, wherein the subsea apparatus comprises a fluid conduit, and the mated connectors provide fluid connection between the conduit and the measuring means.

19. An assembly in accordance with claim 18, wherein the measuring means, in said measurement mode, is arranged to apply pressure to fluid contained in the conduit, via the mated connectors.

20. An assembly in accordance with claim 1, wherein the mated connectors comprise at least one pair of mated electrical contacts and sealing means arranged to prevent contact between sea water and the mated electrical contacts.

21. An assembly in accordance with claim 20, wherein one of said mated connectors comprises a fixed pin having a non-conducting base portion and a conducting tip portion, and the other one of said mated connectors comprises said sealing means, a movable pin, a spring biasing the movable pin towards a first position, and an electrical contact, the arrangement being such that in the mated arrangement, the fixed pin displaces the movable pin from the first position, compressing said spring, such that the conducting tip portion makes electrical connection to the electrical contact and the sealing means forms a seal around the base portion to prevent sea water from making contact with the electrical contact or the tip portion, and such that when the mated connectors are disconnected the spring urges the movable pin into said first position in which the sealing means forms a seal around the movable pin and prevents sea water from making contact with said electrical contact.

22. An assembly in accordance with claim 21, wherein said test apparatus comprises said connector comprising a movable pin.

23. An assembly in accordance with claim 2, wherein said triggering means comprises a light detector and is arranged to trigger the measuring means to operate in said measurement mode in response to detection of light by the light detector.

24. An assembly in accordance with claim 1, wherein the indicating means comprises a visual display.

25. An assembly in accordance with claim 1, wherein the disconnection means comprises handle means, the handle means comprising at least one of: a bar; a T-bar; or a loop.

26. An assembly in accordance with claim 1, wherein the test apparatus comprises a rigid housing, the test apparatus connector being rigidly coupled to said housing, and the measuring means being contained within said housing.

27. Subsea test apparatus comprising:

a connector for mating with a corresponding connector of subsea apparatus to provide at least one of electrical, optical, and fluid connection between the test apparatus and the subsea apparatus;

measuring means connected to the test apparatus's connector and operable underwater in a measurement mode;

a power supply arranged to power the measuring means; and disconnection means for disconnecting the test apparatus's connector from a mated subsea apparatus's connector, wherein the measuring means, in said measurement mode, is arranged to perform at least one measurement, via the mated connectors, on connected subsea apparatus, and the test apparatus further comprises indicating means operable underwater and arranged to provide an indication of a result of the or each measurement.

28. Apparatus in accordance with claim 27, further comprising triggering means for triggering the measuring means to operate in said measurement mode.

29. Apparatus in accordance with claim 27, wherein the indicating means is arranged to provide said indication only when the measuring means is in said measurement mode.

30. Apparatus in accordance with claim 27, wherein the disconnection means comprises handle means arranged so as to be pullable to exert a force to disconnect the test apparatus's connector from a mated subsea apparatus's connector.

31. Apparatus in accordance with claim 27, wherein the subsea test apparatus's connector is adapted for push-fit mating in a sea-water environment with a corresponding connector of other subsea apparatus.

32. Apparatus in accordance with claim 27, wherein the test apparatus's connector comprises at least one electrical contact for forming an electrical connection to a corresponding electrical contact of a corresponding connector, the electrical contact being connected to the measuring means.

33. Apparatus in accordance with claim 32, wherein the measuring means, in said measurement mode, is arranged to measure an electrical impedance between said electrical contact and seawater.

34. Apparatus in accordance with claim 32, wherein the measuring means, in said measurement mode, is arranged to apply a voltage pulse to the electrical contact and to monitor a voltage of the electrical contact following the pulse.

35. Apparatus in accordance with claim 27, wherein the connector comprises a plurality of electrical contacts, each for forming an electrical connection to a corresponding electrical contact of a corresponding connector, and each being connected to the measuring means, and wherein the measuring means, in said measurement mode, is arranged to measure an electrical impedance between one of said plurality of electrical contacts and another one of said plurality of electrical contacts.

36. Apparatus in accordance with claim 35, wherein said plurality of electrical contacts comprises at least three electrical contacts, and the measuring means is arranged, in said measurement mode, to measure an electrical impedance between at least one selected pair of the at least three contacts.

37. Apparatus in accordance with claim 36, wherein the measuring means comprises means for selecting a pair of the at least three contacts, means for applying a test voltage between the selected pair, and means for determining a current flowing between the selected pair.

38. Apparatus in accordance with claim 37, wherein the means for selecting comprises controllable switch means.

39. Apparatus in accordance with claim 32, wherein the measuring means comprises switch means controllable to electrically isolate the or each electrical contact from the power supply.

40. Apparatus in accordance with claim 32, wherein the test apparatus comprises switch means controllable to electrically isolate the or each electrical contact from the measuring means.

41. Apparatus in accordance with claim 27, wherein the connector comprises an optical element for forming an optical connection to a corresponding optical element of a corresponding connector, the optical element being connected to the measuring means.

42. Apparatus in accordance with claim 41, wherein the measuring means, in said measurement mode, is arranged to transmit an optical pulse from said optical element.

43. Apparatus in accordance with claim 27, wherein the connector comprises a fluid connector for forming a fluid connection to a corresponding fluid connector of a corresponding connector, the fluid connector being connected to the measuring means.

44. Apparatus in accordance with claim 43, wherein the measuring means, in said measurement mode, is arranged to apply pressure to fluid contained in the fluid connector.

45. Apparatus in accordance with claim 27, wherein the connector comprises at least one electrical contact, for forming a respective electrical connection to a corresponding electrical contact of a corresponding connector, and sealing means arranged to prevent contact between sea water and the or each electrical contact when the connector is not mated and when the connector is mated with a corresponding connector.

46. Apparatus in accordance with claim 45, wherein the connector comprises said sealing means, a movable pin, a spring biasing the movable pin towards a first position, and an electrical contact, and the connector is adapted to mate with a corresponding connector comprising a fixed pin having a non-conducting base portion and a conducting tip portion, the arrangement being such that in the mated arrangement, the fixed pin displaces the movable pin from the first position, compressing said spring, such that the conducting tip portion makes electrical connection to the electrical contact and the sealing means forms a seal around the base portion to prevent sea water from making contact with the electrical contact or the tip portion, and such that when the mated connectors are disconnected the spring urges the movable pin into said first position in which the sealing means forms a seal around the movable pin and prevents sea water from making contact with said electrical contact.

47. Apparatus in accordance with claim 28, or with any one of claims 29 to 46 as depending from claim 28, wherein said triggering means comprises a light detector and is arranged to trigger the measuring means to operate in said measurement mode in response to detection of light by the light detector.

48. Apparatus in accordance claim 27, wherein the indicating means comprises a visual display.

49. Apparatus in accordance with claim 27, wherein the disconnecting means comprises handle means, the handle means comprising at least one of: a bar; a T-bar; or a loop.

50. Apparatus in accordance with claim 27, comprising a rigid housing, the connector being rigidly coupled to said housing, and the measuring means being contained within said housing.

51. Apparatus in accordance with claim 27, wherein the test apparatus further comprises a memory for storing the result of the at least one measurement.

52. Apparatus in accordance with claim 27, wherein the indicating means comprises a data connector for communicating the result of the at least one measurement to other equipment.

53. A method of handling subsea apparatus having a connector for mating in a sea-water environment with a corresponding connector of other subsea apparatus to provide at least one of electrical, optical, and fluid connection between the two, the method comprising:

connecting subsea test apparatus to the subsea apparatus by mating a connector of the test apparatus to the connector of the subsea apparatus;

providing the subsea apparatus and connected test apparatus at a subsea location;

operating, at said subsea location, electrically powered measuring means of the test apparatus to perform at least one measurement on the connected subsea apparatus via the mated connectors;

providing, with the test apparatus at said subsea location, an indication of a result of the or each measurement;

according to said indication, disconnecting the test apparatus from the subsea apparatus; and mating the connector of the subsea apparatus to the corresponding connector of other subsea apparatus.

54. A method in accordance with claim 53, further comprising triggering, at said subsea location, the measuring means to perform said at least one measurement.

55. A method in accordance with claim 53, wherein said disconnecting comprises pulling handle means of the test apparatus.

56. A method in accordance with claim 53, wherein said connecting and said mating each comprise push-fit mating.

57. A method in accordance with claim 53, wherein said connecting comprises push-fit mating said connectors in a sea water environment.

58. A method in accordance with claim 53, wherein said connecting comprises push-fit mating said connectors in a dry environment.

59. A method in accordance with claim 53, wherein said triggering comprises triggering the measuring means using a remotely operated vehicle (ROV) or diver.

60. A method in accordance with claim 59, wherein said triggering comprises emitting light from a light source, and detecting the emitted light with a light detector provided on the test apparatus.

61. A method in accordance with claim 53, wherein providing said indication comprising providing a visible indication using a visual display.

62. A method in accordance with claim 49, further comprising viewing said visible indication using a camera of an ROV.

63. A method in accordance with claim 53, wherein said disconnecting comprising pulling handle means (e.g. using an ROV).

64. A method in accordance with claim 53, wherein said at least one measurement comprises an electrical impedance measurement.

65. A method in accordance with claim 53, wherein said at least one measurement comprises a time domain reflectometry measurement.

66. A method in accordance with claim 53, wherein said at least one measurement comprises a measurement of an attenuation of an electrical or optical signal.

67. A method in accordance with claim 53, wherein said at least one measurement comprises a pressure measurement.

68. A method in accordance with claim 53, comprising operating the connected test apparatus in a dormant mode until operating the measuring means to perform said at least one measurement, the dormant mode being a mode in which the measuring means is not performing any measurement on the attached apparatus.

69. A method in accordance with claim 68, wherein said dormant mode further comprises isolating electrical contacts of the test apparatus connector from the test apparatus power supply.

70. A method in accordance with claim 53, wherein said connecting by mating comprises forming at least one seal between the connector of the test apparatus and the connector of the subsea apparatus, the at least one seal preventing seawater from contacting at least one of an electrical connection, an optical connection, or a fluid connection between the connectors.

* * * * *